US007880383B2

(12) United States Patent
Chang et al.

(10) Patent No.: US 7,880,383 B2
(45) Date of Patent: Feb. 1, 2011

(54) ELECTRON EMISSION DISPLAY

(75) Inventors: Dong-Su Chang, Yongin-si (KR); Hyeong-Rae Seon, Yongin-si (KR); Jae-Young Lee, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 321 days.

(21) Appl. No.: 11/692,873

(22) Filed: Mar. 28, 2007

(65) Prior Publication Data

US 2008/0048550 A1 Feb. 28, 2008

(30) Foreign Application Priority Data

Aug. 23, 2006 (KR) ..... 10-2006-0080038

(51) Int. Cl.
*H01J 1/62* (2006.01)
*H01J 63/04* (2006.01)

(52) U.S. Cl. ..... 313/512; 313/309

(58) Field of Classification Search ..... 313/495–497, 313/306, 309, 310, 293–304
See application file for complete search history.

(56) References Cited

U.S. PATENT DOCUMENTS

2003/0057825 A1* 3/2003 Kusunoki et al. ..... 313/495
2005/0218785 A1* 10/2005 Lee et al. ..... 313/495
2005/0245117 A1* 11/2005 Ha ..... 439/277

* cited by examiner

*Primary Examiner*—Toan Ton
*Assistant Examiner*—Zachary Snyder
(74) *Attorney, Agent, or Firm*—Christie, Parker & Hale, LLP

(57) ABSTRACT

An electron emission device includes first and second substrates facing each other, an electron emission unit provided on a first surface of the first substrate, a light emission unit provided on a first surface of the second substrate facing the first substrate, and a sealing member for sealing peripheries of the first and second substrates together. The sealing member contacts a first insulation layer of the electron emission unit.

23 Claims, 6 Drawing Sheets

ELECTRON EMISSION DISPLAY

CROSS-REFERENCE TO RELATED APPLICATION

This application claims priority to and the benefit of Korean Patent Application No. 10-2006-0080038, filed in the Korean Intellectual Property Office, on Aug. 23, 2006, the entire content of which is incorporated herein by reference.

BACKGROUND OF THE INVENTION

1. Field of the Invention

The present invention relates to an electron emission display.

2. Description of Related Art

In general, electron emission elements are classified into those using hot cathodes as an electron emission source, and those using cold cathodes as the electron emission source. There are several types of cold cathode electron emission elements, including Field Emitter Array (FEA) elements, Surface Conduction Emitter (SCE) elements, Metal-Insulator-Metal (MIM) elements, and Metal-Insulator-Semiconductor (MIS) elements.

An FEA element includes electron emission regions, cathode electrodes, and gate electrodes. The cathode and gate electrodes are driving electrodes. The electron emission regions are formed by a material having a relatively low work function or a relatively large aspect ratio, such as a molybdenum-based material, a silicon-based material, and a carbon-based material, such as carbon nanotubes, graphite, and diamond-like carbon so that electrons can be effectively emitted when an electric field is applied thereto under a vacuum atmosphere (or vacuum state). When the electron emission regions are formed by the molybdenum-base material or the silicon-based material, they are formed as a pointed tip structure.

The electron emission elements are arrayed on a first substrate to establish an electron emission device. The electron emission device is combined with a second substrate, on which a light emission unit (having a phosphor layer, a black layer, and an anode electrode) is formed. The first and second substrates, the electron emission device, and the light emission unit establish an electron emission display.

In the conventional electron emission display, the first and second substrates facing each other are sealed together at their peripheries using a sealing member and the inner space between the first and second substrates is exhausted to form a vacuum envelope (or vacuum chamber). Here, the electron emission regions, the driving electrodes, and the phosphor layers are provided inside of the vacuum envelope. That is, the electron emission device (or unit) and the light emission unit are provided inside of the vacuum envelope. The vacuum envelope has an effective area where light is actually emitted to display an image, and a non-effective area where there is no light emission to display an image.

The sealing member may include frit bars. Alternatively, the sealing member may include a glass frame and adhesive layers having frit.

The frit bar is formed by a mixture of glass frit and organic compound through a protrusion molding process. The frit bars are disposed between the first and second substrates and the first and second substrates are adhered to each other as the frit bars are heated to a molten state at a high temperature in the sealing process.

Also, when the sealing member seals the first and second substrates together, the sealing member contacts the driving electrodes (cathode or gate electrodes) arranged on the non-effective area.

Here, portions of the driving electrodes, which contact the sealing member, are leads (or extreme ends) of the driving electrode included in the electron emission device (or unit) and extending from the effective area to the peripheries of the first and second substrates.

That is, the sealing member adheres the first and second substrates to each other while contacting directly the extreme ends of the driving electrodes, thereby forming the vacuum envelope. Here, although the frit of the sealing member is the insulation material, it has a relatively low insulation property and a high permittivity as compared with other insulation materials.

Therefore, when the electron emission display is driven and thus an electric current flows along a first driving electrode, e.g., a cathode electrode formed on the first substrate by applying a driving voltage to the first driving electrode, the current flows to a second driving electrodes adjacent to the first driving electrode through the frit, thereby interfering with electric potential of the second (or adjacent) driving electrode. This causes the distortion of the voltage of the adjacent driving electrode. Here, the first and second electrodes refer to two adjacent driving electrodes among a plurality of driving electrodes arranged on the first substrate in a stripe pattern.

SUMMARY OF THE INVENTION

An aspect of the present invention provides an electron emission display in which a distortion of a driving voltage, which is caused by a sealing member, can be reduced or prevented by improving a sealing structure between a first substrate and a second substrate to block or prevent driving electrodes from directly contacting the sealing member.

Another aspect of the present invention provides an electron emission display having an improved sealing structure that can reduce or prevent voltage distortion of a cathode electrode.

According to an exemplary embodiment of the present invention, there is provided an electron emission display including: a first substrate; a second substrates facing the first substrate; an electron emission unit provided on a first surface of the first substrate; a light emission unit provided on a first surface of the second substrate facing the first substrate; and a sealing member for sealing peripheries of the first and second substrate together. Here, the sealing member contacts an insulation layer of the electron emission unit.

The electron emission unit may include: a first electrode formed on the first substrate and extending along a first direction; a second electrode formed on the first substrate and extending along a second direction crossing the first direction with the insulation layer interposed between the first and second electrodes; and an electron emission region formed on the first electrode and electrically connected to the first electrode.

Alternatively, the electron emission unit may include: a first electrode formed on the first substrate and extending along a first direction; a second electrode formed on the first substrate and extending along a second direction crossing the first direction with a first insulation layer interposed between the first and second electrodes; and a third electrode disposed on the second electrode with a second insulation layer interposed between the second and third electrodes, wherein the insulation layer is the first insulation layer or the second insulation layer.

The second insulation layer may extend out of an effective area of the first substrate so that the sealing member contacts the second insulation layer.

The sealing member may be formed by a frit bar and the electron emission region may be formed by a material selected from the group consisting of carbon nanotubes, graphite, graphite nanofibers, diamonds, diamond-like carbon, $C_{60}$, silicon nanowires, and combinations thereof.

The light emission unit may include a phosphor layer formed on the second substrate and an anode electrode formed on the second substrate and connected to the phosphor layer.

According to another exemplary embodiment of the present invention, there is provided an electron emission display including: a first substrate; a second substrate facing the first substrate; an electron emission unit provided on a first surface of the first substrate; a light emission unit provided on a first surface of the second substrate facing the first substrate; a sealing member for sealing peripheries of the first and second substrates together; and an insulation portion interposed between the first substrate and the sealing member.

The sealing member may be formed by a frit bar.

The electron emission unit may include: a first substrate; a second substrate facing the first substrate; an electron emission unit provided on a first surface of the first substrate; a light emission unit provided on a first surface of the second substrate facing the first substrate; a sealing member for sealing peripheries of the first and second substrates together; and an insulation portion interposed between the first substrate and the sealing member.

The electron emission display may further include a focusing electrode formed on the first and second electrodes and insulated from the first and second electrodes.

The electron emission region may be formed by a material selected from the group consisting of carbon nanotubes, graphite, graphite nanofibers, diamonds, diamond-like carbon, $C_{60}$, silicon nanowires, and combinations thereof.

The insulation portion may be spaced apart from at least three insulation layers by a distance therebetween.

The light emission unit may include a phosphor layer formed on the second substrate and an anode electrode formed on the second substrate and connected to the phosphor layer.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF INVENTION

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

Figure 1:
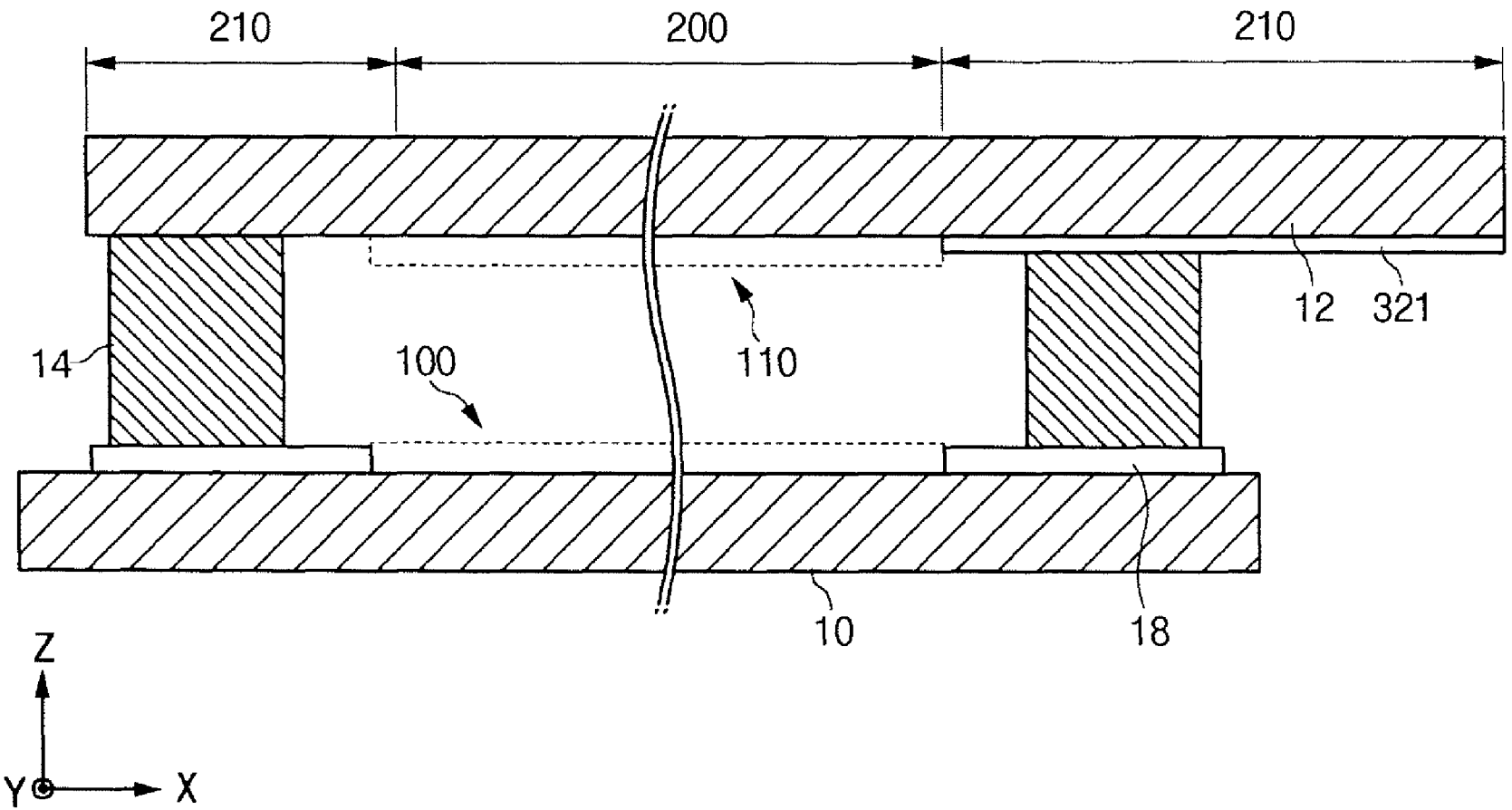
FIG. 1 is a sectional view of an electron emission display illustrating a concept of the present invention.
Figure 2:
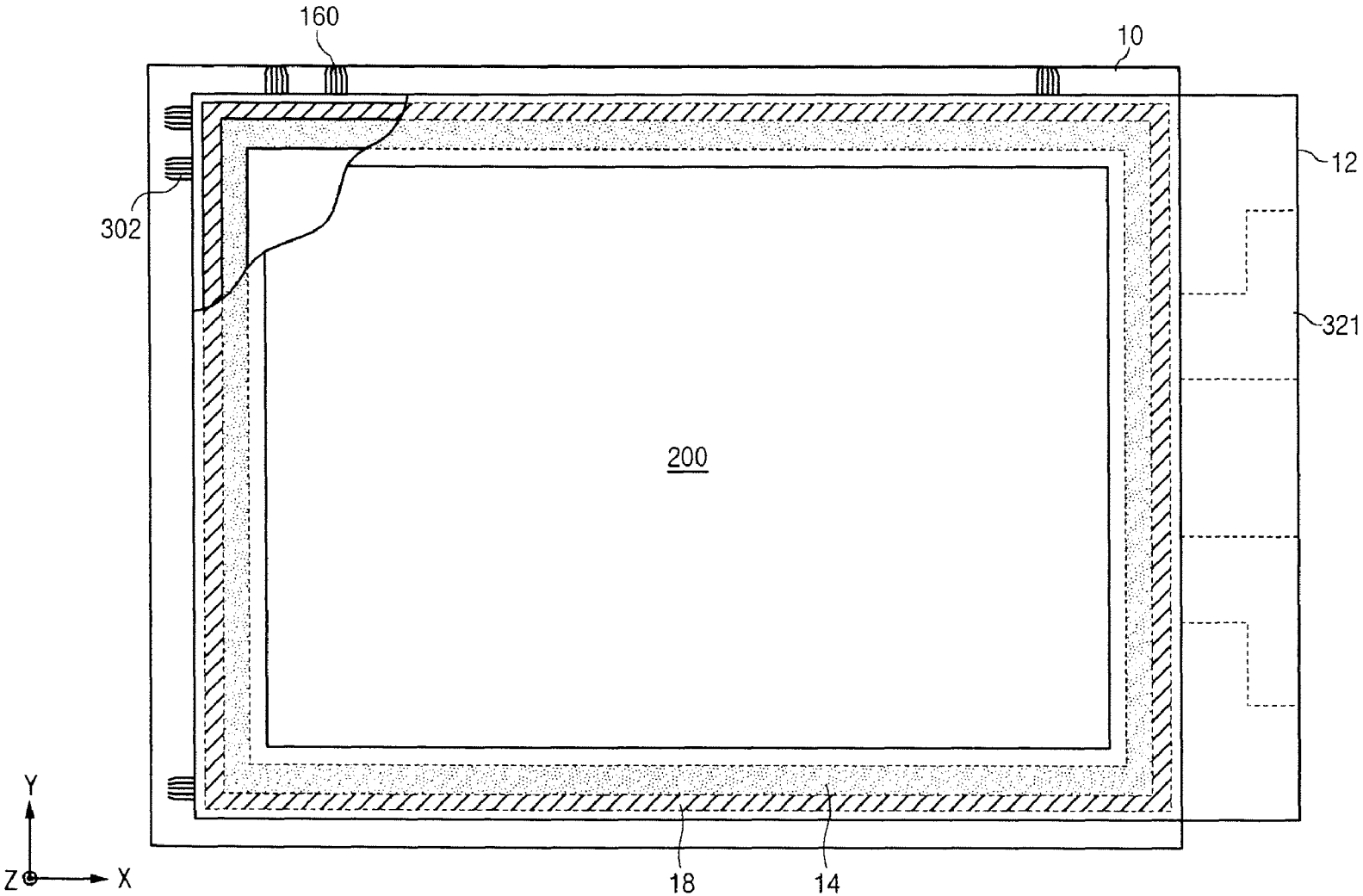
FIG. 2 is a top view of the electron emission display of FIG. 1.

FIGS. 1 and 2 show an electron emission display according to an embodiment of the present invention.

The electron emission display includes first and second substrates 10 and 12 facing each other and spaced apart by a distance therebetween (wherein the distance therebetween may be predetermined). A sealing member (not shown) is provided at the peripheries of the first and the second substrates 10 and 12 to seal them together, thereby forming an envelope. The interior of the envelope is exhausted and kept at a degree of vacuum of about $10^{-6}$ Torr.

The sealing member 14 may include frit bars formed by a mixture of glass frit and organic compound through an extrusion molding process. Alternatively, the sealing member 14 may include a glass frame and adhesive layers formed on top and bottom surfaces of the glass frame. In a sintering process, the frit bars or the adhesive layers are then heated to a molten state to bond the first and second substrates 10 and 12 together.

An electron emission device (or unit) 100 on which electron emission elements are arrayed is provided on a surface of the first substrate 10 facing the second substrate 12 and a light emission unit 110 including phosphor layers and an anode electrode is provided on a surface of the second substrate 12 facing the first substrate 10.

The first substrate 10 on which the electron emission unit 100 is provided is combined with the second substrate 12 on which the light emission unit 110 is provided to form the electron emission display.

Here, since a lead line 321 of the anode electrode extend from the light emission unit 110 to an edge of the second substrate 12 over the sealing member 14, the lead line 321 of the anode electrode is connected to an external driving circuit unit (not shown). Therefore, the anode electrode receives a high voltage required for accelerating electron beams through the lead line 321 of the anode electrode.

In addition, leads 160 of a plurality of first electrodes (cathode electrodes or data electrodes) and leads 302 of a plurality of second electrodes (gate electrodes or scan electrodes) are formed at the first substrate 10 and connected to one or more external driving circuits.

The above-described electron emission display has an effective area 200 that corresponds to where the electron emission unit 100 and the light emission unit 110 are provided to perform the electron emission and the image display and an non-effective area 210 surrounding the effective area 200.

In this embodiment, an insulation layer 18 extends from an end of the effective area 200 of the first substrate 10 to the non-effective area 210 of the first substrate 10, and the sealing member 14 is disposed on the insulation layer 18. Therefore, a direct contact between the electrodes of the electron emission unit 100 formed on the first substrate 10 and the sealing member 14 can be prevented.

The detailed structures of the electron emission unit 100 and the light emission unit 110 and the relationship between the electrodes of the electron emission unit 100 and the sealing member 14 will be described in more detail below.

The above-described concept of the present invention can be applied to an electron emission display having an array of FEA elements, SCE elements, MIM elements, or MIS elements. In the following description, an electron emission display having the array of FEA elements will be exampled in more detail.

Figure 3:
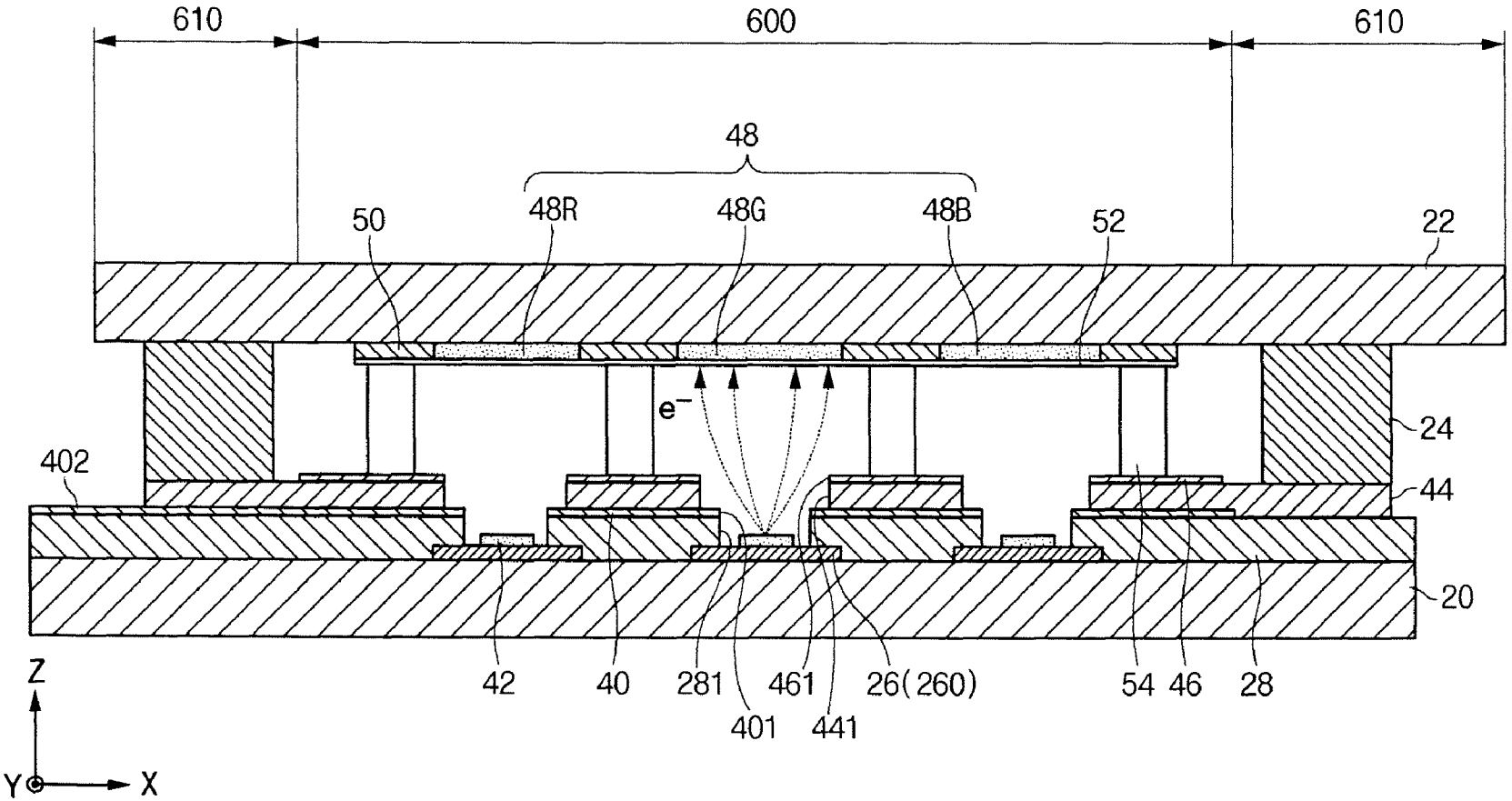
FIG. 3 is a sectional view of an electron emission display having an array of FEA elements according to an embodiment of the present invention.

FIG. 3 is a sectional view of an electron emission display having an array of FEA elements according to an embodiment of the present invention.

Referring to FIG. 3, a plurality of first electrodes (cathode electrodes or data electrodes) 26 are formed on a first substrate 20 in a stripe pattern extending along a first direction (a direction of a Y-axis of FIG. 3).

A first insulation layer 28 is formed on the first substrate 20 while covering the cathode electrodes 26. A plurality of second electrodes (gate electrodes or scan electrodes) 40 are formed on the first insulation layer 28 in a stripe pattern extending along a second direction (a direction of an X-axis of FIG. 3) to cross the cathode electrodes 26 at right angles.

Each crossed region of the cathode and gate electrodes 26 and 40 defines a unit pixel (or pixel unit). Electron emission regions 42 are formed on the cathode electrodes 26 to correspond to the unit pixels.

In addition, first and second openings 281 and 401 corresponding to the electron emission regions 42 are formed on the first insulation layer 28 and the gate electrodes 40 to expose the electron emission regions 42. That is, the electron emission regions 42 are formed on the cathode electrodes 26 through the first and second openings 281 and 401 of the first insulation layer 28 and the gate electrodes 40. In this embodiment, each of the electron emission regions 42 and the first and second openings 281 and 401 is formed to have a circular shape when viewed from a top. However, the present invention is not limited to this shape.

The electron emission regions 42 may be formed by a material, which emits electrons when an electric field is applied thereto under a vacuum atmosphere, such as a carbonaceous material and/or a nanometer-size material. For example, the electron emission regions 42 may be formed by carbon nanotubes, graphite, graphite nanofibers, diamonds, diamond-like carbon, $C_{60}$, silicon nanowires, or combinations thereof. Alternatively, the electron emission regions 42 may be formed as a molybdenum (Mo)-based and/or silicon (Si)-based pointed-tip structure.

Two or more electron emission regions 42 may be arranged at each unit pixel. Here, the electron emission regions 42 may be arranged in series along a length of one of the cathode and gate electrodes 26 and 40. However, the present invention is not limited to the arrangement of the electron emission regions 42 as shown herein.

A second insulation layer 44 and a focusing electrode 46 are successively formed on the gate electrodes 40. The second insulation layer 44 is formed on an entire surface of the first substrate 20 to cover the gate electrodes 40, thereby insulating the gate electrodes 40 from the focusing electrode 46.

Third and fourth openings 441 and 461 for allowing electron beams to pass therethrough are respectively formed on the second insulation layer 44 and the focusing electrode 46.

In this embodiment, one of the third openings 441 of the second insulation layer 44 and one of the fourth openings 461 of the focusing electrode 46 are formed to correspond to a corresponding one of the electrode emission regions 42 at each unit pixel. Alternatively, one of the third openings of the second insulation layer is formed to correspond to a group of the electron emission regions 42 at each unit pixel and a corresponding one of the fourth openings of the focusing electrode is formed to correspond to the one of the third openings.

Also, in this embodiment, the first and second insulation layers 28 and 44 extend from a point of an effective area 600 of the first substrate 20 to a non-effective area 602 of the first substrate 20.

On a surface of the second substrate 22 facing the first substrate 20, phosphor layers 48 such as red, green and blue phosphor layers 48R, 48G and 48B are formed and spaced apart from each other at certain (or predetermined) intervals. Black layers 50 are formed between the phosphor layers 48 to improve the contrast of a screen. The phosphor layers 48 may be formed to correspond to the respective unit pixels defined (or formed) on the first substrate 20.

An anode electrode 52 formed by a conductive (or metallic) material such as aluminum is formed on the phosphor and black layers 48 and 50. The anode electrode 52 functions to heighten the screen luminance by receiving a high voltage required for accelerating the electron beams and reflecting the visible light rays radiated from the phosphor layers 48 to the first substrate 20 back toward the second substrate 22, thereby heightening the screen luminance.

Alternatively, the anode electrode 52 can be formed by a transparent conductive material, such as Indium Tin Oxide (ITO), instead of the metallic material (or metal). In this case, the anode electrode 52 is placed between the second substrate 22 and the phosphor and black layers 48 and 50. Furthermore, when the anode electrode 52 is formed by a transparent conductive material, the electron emission display may further include a metal layer for enhancing the luminance.

Disposed between the first and second substrates 20 and 22 are spacers 54 for uniformly maintaining a gap between the first and second substrates 20 and 22 against an external (or outer) force.

The spacers 54 are arranged on portions of the black layers 28 so as not to intrude (or interfere or trespass) on the phosphor layers 48.

The first and second substrates 20 and 22 are sealed together at their peripheries using a sealing member 24 to form a vacuum envelope (or chamber). The sealing member 24 is deposited on a periphery of one of the first and second substrates 20 and 22 (e.g., the first substrate 20 in this embodiment). Then, the first and second substrates 20 and 22 are bonded together through a sealing process and a sintering process.

The sealing member 24 may be formed by any suitable sealing materials such as frit bars. The sealing member 24 is formed on the first substrate 20 to correspond to an edge of the second insulation layer 44. That is, as shown in FIG. 3, the sealing member 24 is arranged to contact the second insulation layer 44 while directly contacting the second substrate 22 to bond the first and second substrates 20 and 22 together.

Therefore, since the electrodes (cathode and/or gate electrodes) of the electron emission unit formed on the first substrate 20 do not directly contact the sealing member 24, the problem (i.e., the driving voltage distortion problem), which is caused by the contact between the electrodes of the electron emission unit and the sealing member in the conventional art, can be solved.

Figure 4A:
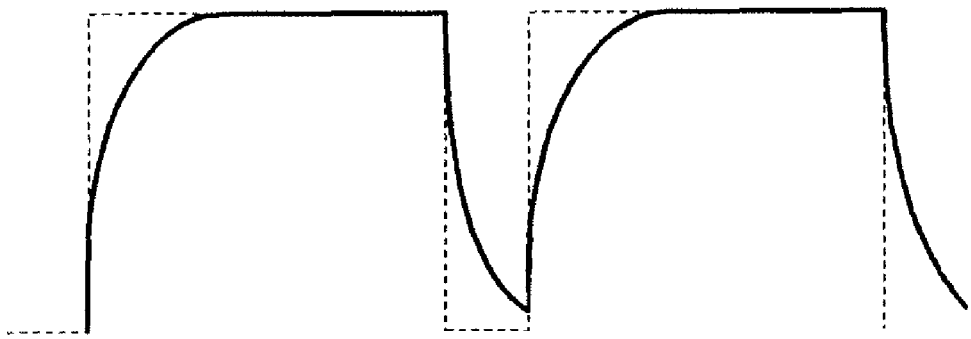
FIG. 4A is a view illustrating a driving voltage waveform applied to cathode electrodes of an electron emission display having an array of FEA elements according to an embodiment of the present invention.

FIG. 4A is a view illustrating a driving voltage waveform of cathode electrodes of an electron emission display according to an embodiment of the present invention.

Figure 4B:
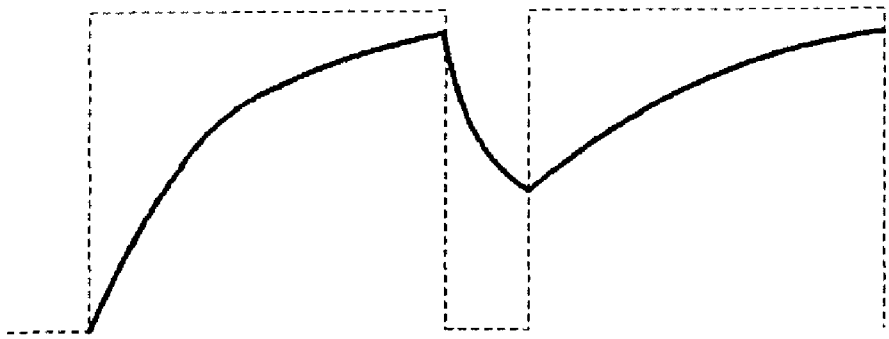
FIG. 4B is a view illustrating a conventional driving voltage waveform.

Referring to FIG. 4A, the distortion degree of the driving voltage waveform in the embodiment of the present invention is considerably less when compared to the distortion degree of the driving voltage waveform in the conventional art as shown in FIG. 4B. In each of FIGS. 4A and 4B, the solid line is an example of the actual (or effective) driving voltage waveform and the dotted line is the ideal driving voltage waveform.

Furthermore, leads 402 of the gate electrodes 40 are disposed between the first and second insulation layers 28 and 44 and exposed to an external side of the vacuum envelope. The leads 402 are connected to a driving circuit (not shown). Leads 260 of the cathode electrodes 26 are disposed between the first substrate 20 and the first insulation layer 28 and exposed to the external side of the vacuum envelope that is also connected to a driving circuit (not shown).

Here, since the leads 260 of the cathode electrodes 26 and the leads 402 of the gate electrodes 40 are respectively covered (or separated from the sealing member 21) by the first and second insulation layers 28 and 44, the leads 260 and 402 do not contact the sealing member 24.

Figure 5:
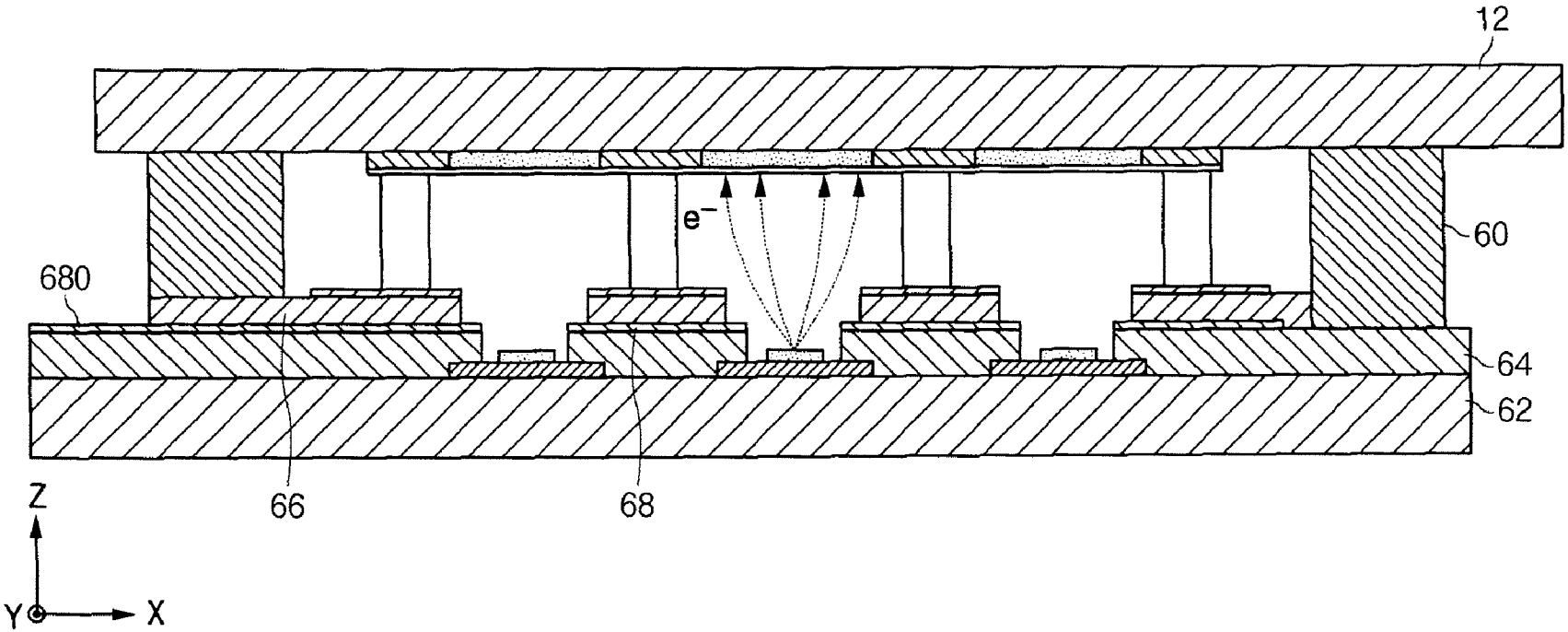
FIG. 5 is a sectional view of an electron emission display having an array of FEA elements according to another embodiment of the present invention.

FIG. 5 is a sectional view of an electron emission display having an array of FEA elements according to another embodiment of the present invention.

Referring to FIG. 5, an electron emission display of this embodiment is substantially identical to that of the foregoing embodiment of FIG. 3. However, in this embodiment, a sealing member 60 may selectively contact one of first and second insulation layers 64 and 66 formed on a first substrate 62.

That is, a portion of the sealing member 60 disposed at a portion where leads 680 of gate electrodes 68 are arranged to contact the second insulation layer 66, and another portion of the sealing member 60 disposed at a portion facing (or opposite to) the leads 680 of the gate electrodes 68 are arranged to contact the first insulation layer 64.

In addition, another portion of the sealing member 60, which is not shown in FIG. 5, may contact selectively one of the first and second insulation layers 64 and 66. That is, a portion of the sealing member 60 disposed at a portion where leads of cathode electrodes are arranged to contact either the second insulation layer 66 or the first insulation layer 64 depending on whether the second insulation layer 66 is extended to the sealing member. To put it another way, according to the contact state of the sealing member 60, the patterns of the first and second insulation layers 64 and 66 formed on the first substrate 62 are determined.

Figure 6:
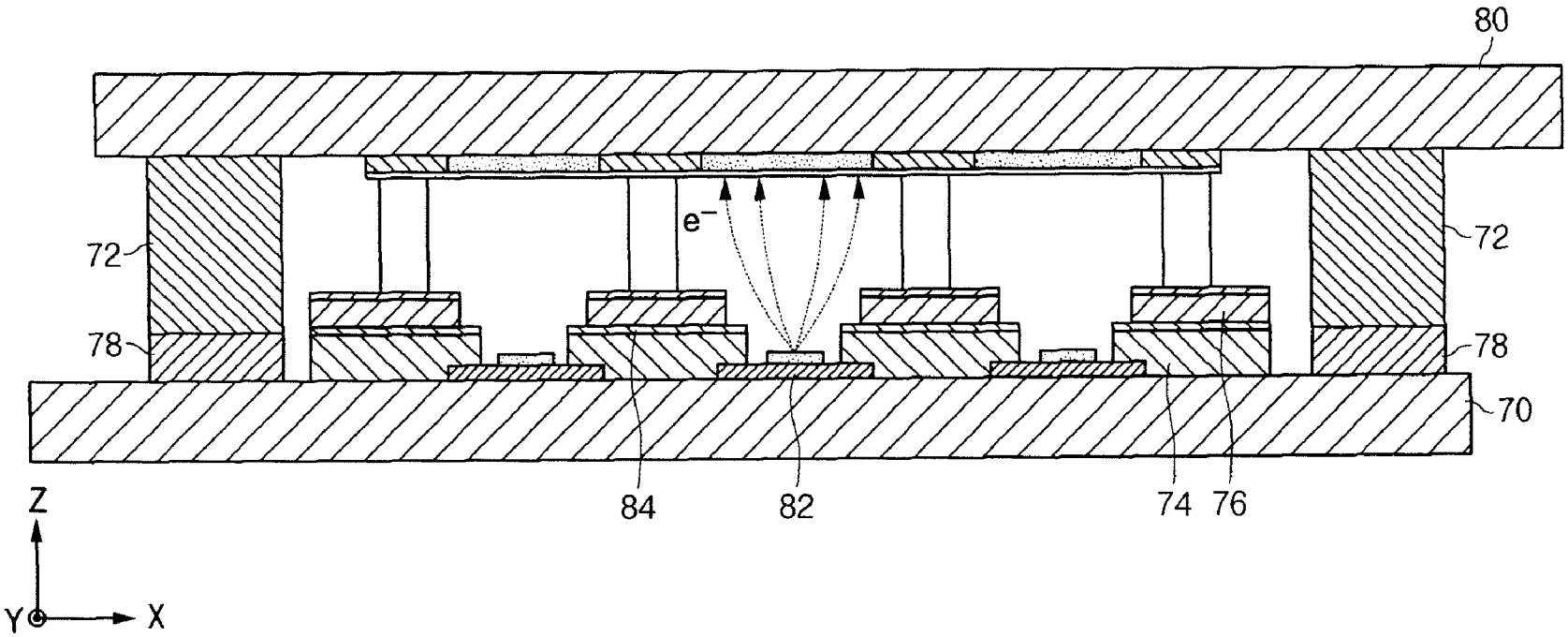
FIG. 6 is a sectional view of an electron emission display having an array of FEA elements according to an embodiment of the present invention.

FIG. 6 is a sectional view of an electron emission display having an array of FEA elements according to an embodiment of the present invention.

Referring to FIG. 6, an electron emission display of this embodiment is substantially identical to that of the foregoing embodiment of FIG. 3 except for a contact portion of a sealing member 72 at a first substrate 70.

That is, according to this embodiment, the sealing member 72 does not contact any one of insulation layers 74 and 76 at the first substrate 70, and instead does contact an insulation portion 78 that is additionally formed.

The insulation portion 78 is interposed between the sealing member 72 and the first substrate 70 and spaced apart from the insulation layers 74 and 76 by a certain (or predetermined) distance. The sealing member 72 contacts the insulation portion 78 to bond the first and second substrates 70 and 80 together. In addition, leads of cathode and gate electrodes 82 and 84 of an electron emission unit extend out of the vacuum envelope through an opening between the insulation portion 78 and the first substrate 70 and are connected to respectively driving circuits.

An operation of the electron emission display depicted in FIG. 3 will now be exemplarily described below.

The electron emission display is driven when a certain (or predetermined) voltage is applied to the cathode, gate, focusing, and anode electrodes 26, 40, 46, and 52.

For example, when the cathode electrodes 26 function as scan electrodes for receiving scan driving voltages, the gate electrodes 40 function as data electrodes for receiving data driving voltages (or vise versa). In this embodiment, the cathode electrodes 26 function as the data electrodes while the gate electrodes 40 function as the scan electrodes.

The focusing electrode 46 receives a voltage required for focusing (or converging) the electron beams, for example, 0V or a negative direct current voltage ranging from several to several tens of volts. The anode electrode 52 receives a direct current voltage that can accelerate the electron beams, for example, ranging from hundreds to thousands of volts.

Electric fields are formed around the electron emission regions 42 at the unit pixels where a voltage difference between the cathode and gate electrodes 26 and 40 is equal to or higher than a threshold value and thus the electrons are emitted from the electron emission regions 42. As a bundle of electron beams, the emitted electrons are focused (or converged) to the central portion of the bundle of the electron beams while passing through the fourth openings 461 of the focusing electrode 46 and strike the phosphor layers 48 of the corresponding unit pixels by the high voltage applied to the anode electrode 52, thereby exciting the phosphor layers 48 to emit light and/or realize an image.

In the electron emission display according to this embodiment, since the insulation layer extends up to the non-effective area that does not relate to the light emission and/or image display and the sealing member is arranged on the insulation layer, direct contact between the electrodes of the electron emission unit and the sealing member can be avoided or prevented.

Accordingly, when the electron emission display is being driven, the voltage distortion caused by a voltage interference between adjacent electrodes can be reduced, minimized, or prevented.

By reducing, minimizing, or preventing the voltage interference, the color reproduction, luminance, and response speed can be improved to improve the display quality.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission display comprising:

a first substrate;

a second substrate facing the first substrate;

an electron emission unit on a first surface of the first substrate;

a light emission unit on a first surface of the second substrate facing the first substrate;

a sealing member for sealing peripheries of the first and second substrates together, the sealing member directly contacting at least one of the first and second substrates;

a first insulation layer between the sealing member and the first substrate; and a second insulation layer between the sealing member and the first insulation layer;

wherein the first insulation layer has a first hole to expose the electron emission unit;

wherein the second insulation layer has a second hole to expose the electron emission unit;

wherein a length of the first insulation layer, extending in a first direction, is greater than a width of the sealing member extending in the first direction;

wherein a length of the second insulation layer, extending in the first direction, is greater than the width of the sealing member extending in the first direction; and wherein the sealing member does not contact any electrode of the electron emission display.

2. The electron emission display of claim 1, wherein the electron emission unit comprises:

a first electrode on the first substrate and extending along a second direction;

a second electrode on the first substrate and extending along a third direction crossing the second direction with the first insulation layer interposed between the first and second electrodes; and an electron emission region on the first electrode and electrically connected to the first electrode.

3. The electron emission display of claim 2, wherein the electron emission region is formed by a material selected from the group consisting of carbon nanotubes, graphite, graphite nanofibers, diamonds, diamond-like carbon, $C_{60}$, silicon nanowires, and combinations thereof.

4. The electron emission display of claim 1, wherein the electron emission unit comprises:

a first electrode on the first substrate and extending along second direction;

a second electrode on the first substrate and extending along a third direction crossing the second direction with the first insulation layer interposed between the first and second electrodes; and a third electrode on the second electrode with the second insulation layer interposed between the second and third electrodes.

5. The electron emission display of claim 4, wherein an electron emission region of the electron emission unit is formed by a material selected from the group consisting of carbon nanotubes, graphite, graphite nanofibers, diamonds, diamond-like carbon, $C_{60}$, silicon nanowires, and combinations thereof.

6. The electron emission display of claim 4, wherein the second insulation layer extends out of an effective area of the first substrate so that the sealing member contacts the second insulation layer.

7. The electron emission display of claim 1, wherein the sealing member is formed by a frit bar.

8. The electron emission display of claim 1, wherein an electron emission region of the electron emission unit is formed by a material selected from the group consisting of carbon nanotubes, graphite, graphite nanofibers, diamonds, diamond-like carbon, $C_{60}$, silicon nanowires, and combinations thereof.

9. The electron emission display of claim 1, wherein the light emission unit comprises:

a phosphor layer on the second substrate; and an anode electrode on the second substrate and connected to the phosphor layer.

10. An electron emission display comprising:

a first substrate;

a second substrate facing the first substrate;

an electron emission unit on a first surface of the first substrate;

a light emission unit on a first surface of the second substrate facing the first substrate;

a sealing member for sealing peripheries of the first and second substrates together, the sealing member directly contacting at least one of the first and second substrates; and an insulation portion interposed between the first substrate and the sealing member, wherein the insulation portion is in contact with both the first substrate and the sealing member, wherein the sealing member does not contact any electrode of the electron emission display.

11. The electron emission display of claim 10, wherein the sealing member is formed by a frit bar.

12. The electron emission display of claim 10, wherein the electron emission unit comprises:

a first electrode on the first substrate and extending along a first direction;

a second electrode on the first substrate and extending along a second direction crossing the first direction with a first insulation layer interposed between the first and second electrodes; and an electron emission region on the first electrode and electrically connected to the first electrode.

13. The electron emission display of claim 12, further comprising a focusing electrode on the first and second electrodes and insulated from the first and second electrodes.

14. The electron emission display of claim 12, wherein the electron emission region is formed by a material selected from the group consisting of carbon nanotubes, graphite, graphite nanofibers, diamonds, diamond-like carbon, $C_{60}$, silicon nanowires, and combinations thereof.

15. The electron emission display of claim 12, wherein the insulation portion is spaced apart from at least three insulation layers by a distance therebetween.

16. The electron emission display of claim 10, wherein the light emission unit comprises:

a phosphor layer on the second substrate; and an anode electrode on the second substrate and connected to the phosphor layer.

17. The electron emission display of claim 10, wherein the electron emission unit comprises:

a first electrode on the first substrate and extending along a first direction;

a second electrode on the first substrate and extending along a second direction crossing the first direction with a first insulation layer interposed between the first and second electrodes.

18. The electron emission display of claim 17, wherein the insulation portion is spaced apart from the first insulation layer by a distance therebetween.

19. The electron emission display of claim 10, wherein the electron emission unit comprises:

a first electrode on the first substrate and extending along a first direction;

a second electrode on the first substrate and extending along a second direction crossing the first direction with a first insulation layer interposed between the first and second electrodes; and a third electrode on the second electrode with a second insulation layer interposed between the second and third electrodes.

20. The electron emission display of claim 19, wherein the insulation portion is spaced apart from the first and second insulation layers by a distance therebetween.

21. The electron emission display of claim 19:

wherein the first insulation layer comprises a first hole to expose the electron emission unit;

wherein the second insulation layer comprises a second hole to expose the electron emission unit; and wherein the second hole is greater than the first hole.

22. The electron emission display of claim 1, wherein the second hole is greater than the first hole.

23. The electron emission display of claim 1, wherein the sealing member contacts the second substrate.

* * * * *